United States Patent [19]

Moriyama et al.

[11] 4,240,989

[45] Dec. 23, 1980

[54] CARBURETOR WITH MULTICONDUIT NOZZLE

[75] Inventors: Akinobu Moriyama; Motomi Arai, both of Yokosuka; Katsushi Yoshikawa, Yokohama; Masaaki Saito, Yokosuka, all of Japan

[73] Assignee: Nissan Motor Company, Limited, Yokohama, Japan

[21] Appl. No.: 44,326

[22] Filed: May 31, 1979

[30] Foreign Application Priority Data

Jun. 2, 1978 [JP] Japan ..... 53-75947[U]

[51] Int. Cl.[3] ..... F02M 29/00

[52] U.S. Cl. ..... 261/78 R; 261/121 A; 261/123; 261/DIG. 39

[58] Field of Search ..... 261/DIG. 39, 123, 78 R, 261/121 A

[56] References Cited

U.S. PATENT DOCUMENTS

| | | | |
|---|---|---|---|
| 1,441,560 | 1/1923 | Connors | 261/123 |
| 1,637,104 | 7/1927 | Crone | 261/41 D |
| 1,791,204 | 2/1931 | Harel | 261/DIG. 39 |
| 2,011,997 | 8/1935 | Cameron | 261/DIG. 39 |
| 2,029,336 | 2/1936 | Palsson | 261/123 |
| 2,086,944 | 7/1937 | Palsson | 261/123 |
| 2,127,444 | 8/1938 | Emerson | 261/DIG. 39 |
| 3,406,952 | 10/1968 | White | 261/121 A |
| 3,452,966 | 7/1969 | Smolski | 261/123 |
| 3,693,947 | 9/1972 | Masaki et al. | 261/121 A |
| 4,150,072 | 4/1979 | Igarashi et al. | 261/121 A |

FOREIGN PATENT DOCUMENTS

| | | | |
|---|---|---|---|
| 354487 | 6/1922 | Fed. Rep. of Germany | 261/DIG. 39 |
| 656336 | 2/1938 | Fed. Rep. of Germany | 261/41 D |
| 13290 | 12/1910 | France | 261/DIG. 39 |
| Ad.23953 | 1/1922 | France | 261/78 R |
| 652789 | 3/1929 | France | 261/121 A |
| 691133 | 10/1930 | France | 261/121 A |
| 875684 | 6/1942 | France | 261/121 A |
| 1106417 | 7/1955 | France | 261/78 R |
| 152538 | 10/1920 | United Kingdom | 261/DIG. 39 |
| 1332502 | 10/1973 | United Kingdom . | |
| 1448128 | 9/1976 | United Kingdom . | |

*Primary Examiner*—Tim R. Miles

*Attorney, Agent, or Firm*—Schwartz, Jeffery, Schwaab, Mack, Blumenthal & Koch

[57] ABSTRACT

A carburetor is provided with a fuel passage which leads to a float chamber and has an air bleed opening therein, and has a nozzle leading from the fuel passage to the intake passage to discharge fuel with air bubbles into it. The nozzle is formed as a multiconduit structure along at least part of its length, in order to improve breaking up of air bubbles in the fuel, and the atomization thereof.

7 Claims, 7 Drawing Figures

FIG. 6A
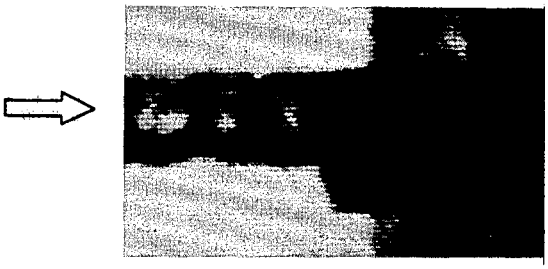
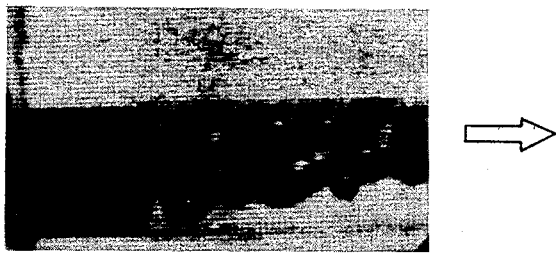
FIG. 6B

CARBURETOR WITH MULTICONDUIT NOZZLE

BACKGROUND OF THE INVENTION

The present invention relates to a carburetor for an internal combustion engine.

In FIG. 1, a conventional carburetor of an internal combustion engine is shown. In this carburetor, a float chamber 5 with a float 6 therein communicates with a fuel passage 9 via a jet 4. An air bleed 7 fitted with an emulsion tube 8 also communicates with this fuel passage 9. A nozzle 3 leads from this fuel passage 9 to a small venturi 2. This small venturi 2 is located within a larger venturi 1.

This kind of carburetor aims at producing a homogeneous mixture of air which is ejected from the air bleed 7 with the fuel from the jet 4, in order to produce a finely divided jet of fuel from the nozzle 3. This air emerges from the emulsion tube 8 as fine bubbles.

However, it is found to be a problem that the air bubbles leaving the holes in the emulsion tube are apt to grow, just before they become detached from the holes, larger than the holes themselves; and further they tend to amalgamate with one another. Thus, although the hole diameter may be about 0.5 mm bubbles of 0.7 mm in size, or even larger, occur. Also, the generation of air bubbles through the holes is intermittent. For these reasons, alternately over-rich and over-lean fuel appear at the nozzle 3, and the so-called "pulsation phenomenon" appears, whereby the stability of revolution speed of the engine is adversely affected, the quality of the exhaust gas suffers, the mixture control accuracy decreases, and the fuel economy drops.

As an aid to uniform mixing of the air and the fuel, it has been proposed in Japanese Utility Model Application No. 66433/76 to provide a heater to apply heat to the fuel with air bubbles before it comes out of the nozzle, thus partially gasifying it. However, this means a complicated carburetor of a radically new structure.

As an alternative, it has been proposed in Japanese Patent Application No. 50960/77 to provide a sponge-like porous member in the fuel nozzle passage of the carburetor, so as to break up the bubbles. However, this proposition is fraught with difficulty, because a sponge-like member presents high resistance to the flow of fuel. If, to combat this, the sponge-like member is made very thin, it becomes so weak that it breaks easily, and further its effect in breaking up the bubbles is diminished. It is extremely difficult to provide a sponge-like member which satisfies the contradictory demands made upon it, in a nozzle of the usual diameter of 3 to 5 mm.

SUMMARY OF THE INVENTION

Therefore, it is an object of the present invention to provide a carburetor for an internal combustion engine in which the air bubbles generated from an air bleed are effectively broken up when they pass through a nozzle.

It is another object of the present invention to provide a carburetor capable of supplying fuel without any pulsation phenomenon, so that the subdivision of the fuel with air bubbles is performed well, thus ensuring stable engine rotation and precision of control of air/fuel ratio, thus decreasing fuel consumption and improving the quality of exhaust gases.

According to the present invention, these and other objects are accomplished by a carburetor, comprising a float chamber, a fuel passage communicating with the float chamber, an air bleed communicating with the fuel passage, an intake passage, and a nozzle, whose one end communicates with the fuel passage and whose other end communicates with the intake passage so as to discharge fuel with air bubbles into it, characterized in that along at least part of its length the nozzle is formed as a multiconduit structure.

This term "multiconduit structure" is used to mean that the cross-section of the nozzle is divided up into several portions, which extend for a substantial distance along the length of the nozzle. This is as contrasted to the aforementioned prior art, in which a porous or sponge-like member subdivided the nozzle passage into a large number of meandering and cross-linked passages. The fuel passes through this multiconduit structure, through the several passages, and while doing so its direction of flow is substantially along the axis of the nozzle, along its length. Thus resistance to the passage of the fuel with air bubbles is minimized, while the effect of dividing up the bubbles is maximized.

According to preferred embodiments of the present invention, this multiconduit structure may be constituted by a bundle of small tubes laid along the length of the nozzle, or by a honeycomb shaped partition with passages arranged lengthwise along the length of the nozzle.

Further, as two of many possibilities, it is envisaged either to provide the said multiconduit structure substantially along the entire length of the nozzle, or to provide it in two separate places along the length of the nozzle, with a portion between where the nozzle is formed as a single-conduit structure. Of course, more than two multiconduit portions could also be provided.

BRIEF DESCRIPTION OF THE DRAWINGS

These and other objects, features, and advantages of the present invention will become better understood from the following description of several preferred embodiments of the present invention, taken in conjunction with the accompanying drawings, which, however, are not intended to be in any way limitative of the present invention, but are given for purposes of illustration only. In the drawings:

FIGS. 6A and 6B are figures showing fuel with air bubbles before and after passing through a nozzle of the present invention, showing its subdivision. These figures are in fact video photographs.

DETAILED DESCRIPTION OF THE PREFERRED EMBODIMENTS

Figure 1:
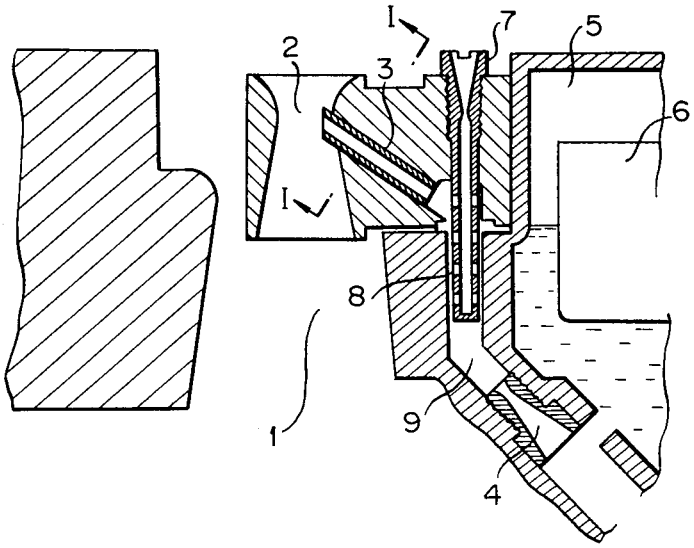
FIG. 1 is a vertical section of a conventional carburetor.
Figure 2:
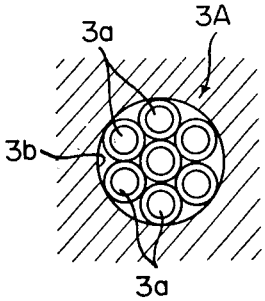
FIG. 2 is a cross-sectional view of a nozzle passage in a carburetor which is a first embodiment of the present invention, taken along a line which, in that carburetor, corresponds to the line I—I in FIG. 1.

FIG. 2 shows a first embodiment of the present invention, in somewhat diagrammatical form. The cross-section of the passage through the nozzle of the carburetor of FIG. 1 is changed, by being formed as a multiconduit structure, designated by symbol 3A, over a part of its length. This structure is formed by a bundle of fine (about 0.5–2 mm diameter) tubes 3*a* abutted together and fixed in the hole 3*b* of the nozzle. These tubes extend along the length of the nozzle. The fuel with air bubbles can pass not only through the holes of the tubes 3*a*, but also between them, and between them and the wall 3*b* of the nozzle passage. The inner diameter of this passage is, for example, about 2.5 to 6 mm. Thus, by passing through this multiconduit structure, the bubbles in the fuel are positively broken up in a much more effective fashion than in the prior art sponge-like device. The flow resistance of this structure is also substantially smaller than that of the prior art structures.

Figure 3:
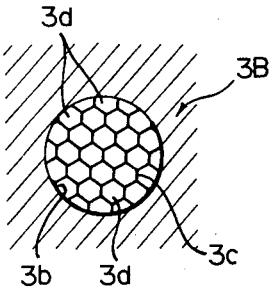
FIG. 3 is a view similar to FIG. 2, of another embodiment of the present invention.

FIG. 3 shows a second embodiment of the present invention. In this, the multiconduit structure, designated by symbol 3B, is provided by a sort of honeycomb-shaped member, the passages of which extend along the length of the nozzle passage, and which therefore partitions up the cross-section of the nozzle passage into several different flow passages 3*d*. Each of these passages may have a caliber of approximately 0.5–2 mm. Of course the shape of the so-called honeycomb member is not limited to the hexagonal shape.

Figure 4:
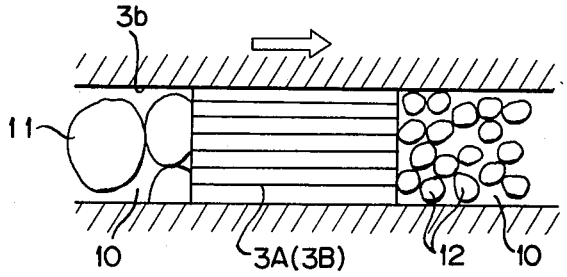
FIG. 4 is a schematic view in longitudinal section of the nozzle shown in FIG. 3.

FIG. 4 shows the operation of the multiconduit structure of the carburetor of the present invention. As can be seen, the large air bubbles 11 within fuel 10 which enter into the multiple conduits 3A or 3B from the left are subdivided into much smaller bubbles at the right as they leave the conduits. Because the flow resistance of the nozzle is not increased much by this multiconduit structure, pulsation of the supply of fuel is avoided. Thus, finely divided fuel is sprayed from the nozzle into the engine intake passage.

Figure 5:
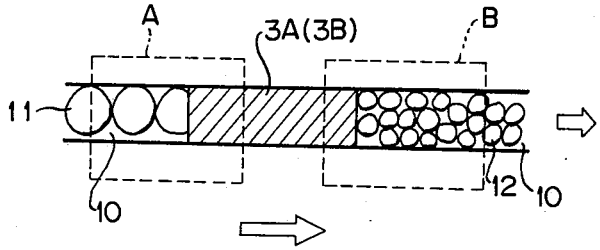
FIG. 5 is a schematic view similar to FIG. 4, for explaining the operation of the nozzles of the carburetor of the present invention.

FIG. 5 is a diagram similar to FIG. 4, and the areas in FIG. 5 marked A and B are shown in the video photographs 6A and 6B, respectively. FIG. 6A shows the air bubbles before they have entered the multiconduit structure, and herein they may be seen to be relatively large in size. In FIG. 6B, it is seen that after these bubbles have passed through the multiconduit structure their size has been greatly reduced.

According to the present invention, the multiconduit structure may be provided all along the nozzle passage, or only at a portion thereof, or at two separate portions, which are divided by a part of the nozzle passage which is of a single-conduit form. Further, it is quite within the scope of the present invention to provide the multiconduit structure as encased inside an outer tube, or directly set within the body of the carburetor. Various other modifications of the form and the detail of various embodiments of the present invention will be easily made by one skilled in the art, based upon the foregoing disclosure, without departing from the scope of the invention, which should not delimited by any details of the embodiments shown, or of the drawings, but solely by the accompanying claims.

It should be noted that one of the particular advantages of the present invention is that it can be applied to an existing carburetor simply by changing the nozzle. This is a considerable economic advantage.

We claim:

1. A carburetor assembly for an internal combustion engine, comprising:

an intake passage for supplying a combustible mixture of fuel and air to the engine;

a venturi provided in said intake passage;

a float chamber for maintaining the fuel at a predetermined level;

a narrow fuel passge communicating with said float chamber;

an air bleed communicating with said fuel passage;

an emulsion tube extending from said air bleed into said fuel passage, said emulsion tube including means for producing a homogenous mixture of the fuel from said float chamber with the air from said air bleed in such a way that the air from said air bleed emerges from said emulsion tube as fine bubbles; and a nozzle having one end thereof communicating with said venturi and the other end thereof communicating with said fuel passage, said nozzle supplying said homogenous mixture of fuel and air bubbles to said venturi; and said nozzle having along at least the part of its length near the venturi a multiconduit structure comprising a plurality of passageways extending axially along a substantial portion of said nozzle and having a diameter so that said fine bubbles in the fuel are positively broken up to produce much smaller bubbles in the fuel when the bubbles in the fuel have passed through said multiconduit structure, without substantial increase in flow resistance.

2. A carburetor assembly for an internal combustion engine as defined in claim 1, wherein said nozzle comprises a nozzle passage having a diameter between about 2.5 and 6 mm, and wherein said multiconduit structure comprises passageways each having a diameter of from about 0.5 to 2 mm.

3. A carburetor assembly for an internal combustion engine as defined in claim 1, wherein said multiconduit structure of said nozzle comprises a plurality of pipes having a diameter of from about 0.4–2 mm laid along the length of the nozzle.

4. A carburetor assembly for an internal combustion engine as defined in claim 1, wherein said multiconduit structure of said nozzle comprises a honeycomb-shaped partition having passageways of from about 0.5–2 mm diameter arranged axially along the length of said nozzle.

5. A carburetor assembly for an internal combustion engine as defined in claim 2, 3 or 4, wherein said multiconduit structure extends along substantially the entire length of said nozzle.

6. A carburetor assembly for an internal combustion engine as defined in claim 2, 3 or 4, wherein said multiconduit structure is located at two separated places along the length of said nozzle, while in between these places said nozzle is formed as a single-conduit structure.

7. A carburetor assembly for an internal combustion engine as defined in claim 2, wherein said mixture producing means comprises a plurality of holes in said emulsion tube.

* * * * *